US007774872B2

(12) United States Patent
Sanders, Jr.

(10) Patent No.: US 7,774,872 B2
(45) Date of Patent: Aug. 17, 2010

(54) FOLD DOWN LOFT BED WITH MODULAR FURNITURE

(76) Inventor: James Sanders, Jr., 1470 Casson Ct., Colorado Springs, CO (US) 80919

( * ) Notice: Subject to any disclaimer, the term of this patent is extended or adjusted under 35 U.S.C. 154(b) by 10 days.

(21) Appl. No.: 12/328,534

(22) Filed: Dec. 4, 2008

(65) Prior Publication Data

US 2010/0024122 A1 Feb. 4, 2010

Related U.S. Application Data

(60) Provisional application No. 61/085,104, filed on Jul. 31, 2008.

(51) Int. Cl.
*A47C 17/32* (2006.01)
*A47C 19/22* (2006.01)

(52) U.S. Cl. ..... 5/9.1; 5/8; 5/2.1

(58) Field of Classification Search ..... 5/9.1, 5/8, 10.1, 10.2, 11, 2.1
See application file for complete search history.

(56) References Cited

U.S. PATENT DOCUMENTS

| | | | | | |
|---|---|---|---|---|---|
| 544,980 | A | * | 8/1895 | Hoskins | 105/321 |
| 544,982 | A | * | 8/1895 | Hoskins | 297/62 |
| 2,440,515 | A | * | 4/1948 | Kelly, Jr. et al. | 5/59.1 |
| 2,550,599 | A | * | 4/1951 | Reed | 5/9.1 |
| 2,854,672 | A | * | 10/1958 | Hagstrom | 5/9.1 |
| 2,945,241 | A | * | 7/1960 | Sideroff | 5/8 |
| 3,028,606 | A | * | 4/1962 | Boutet | 5/9.1 |
| 3,311,932 | A | * | 4/1967 | Ahola | 5/9.1 |
| 3,811,138 | A | * | 5/1974 | Del Missier | 5/9.1 |
| 3,829,907 | A | * | 8/1974 | Brunner | 5/8 |
| 4,044,410 | A | | 8/1977 | Klingler | |
| 4,103,373 | A | * | 8/1978 | Luedtke et al. | 5/166.1 |
| 4,312,086 | A | * | 1/1982 | Bianco | 5/2.1 |
| 4,555,821 | A | | 12/1985 | Page | |
| 4,922,561 | A | | 5/1990 | Williams | |
| 4,999,864 | A | | 3/1991 | Crews | |
| 6,167,579 | B1 | | 1/2001 | Kopish | |

* cited by examiner

*Primary Examiner*—Robert G Santos
(74) *Attorney, Agent, or Firm*—Dale J. Ream

(57) ABSTRACT

A loft bed includes a framework including head and foot portions, each having front and back upstanding posts and connector members therebetween. Each portion includes a connector member defining a roller guide channel, each channel extending substantially between respective upstanding posts of the head and foot portions. Each front upstanding post defines a pin guide channel extending vertically therealong between upper and lower guide channel ends. An upper bed frame includes opposed end rails with opposed side rails extending therebetween. A pair of rollers is attached to the end rails of the upper bed frame and receivable in the roller guide channels. A pair of pins is attached to respective ends of the bed frame for receipt in the pin guide channels. Movement of the roller and pins in the channels enables movement of the bed frame between a sleep configuration and selectable folded out configurations.

16 Claims, 14 Drawing Sheets

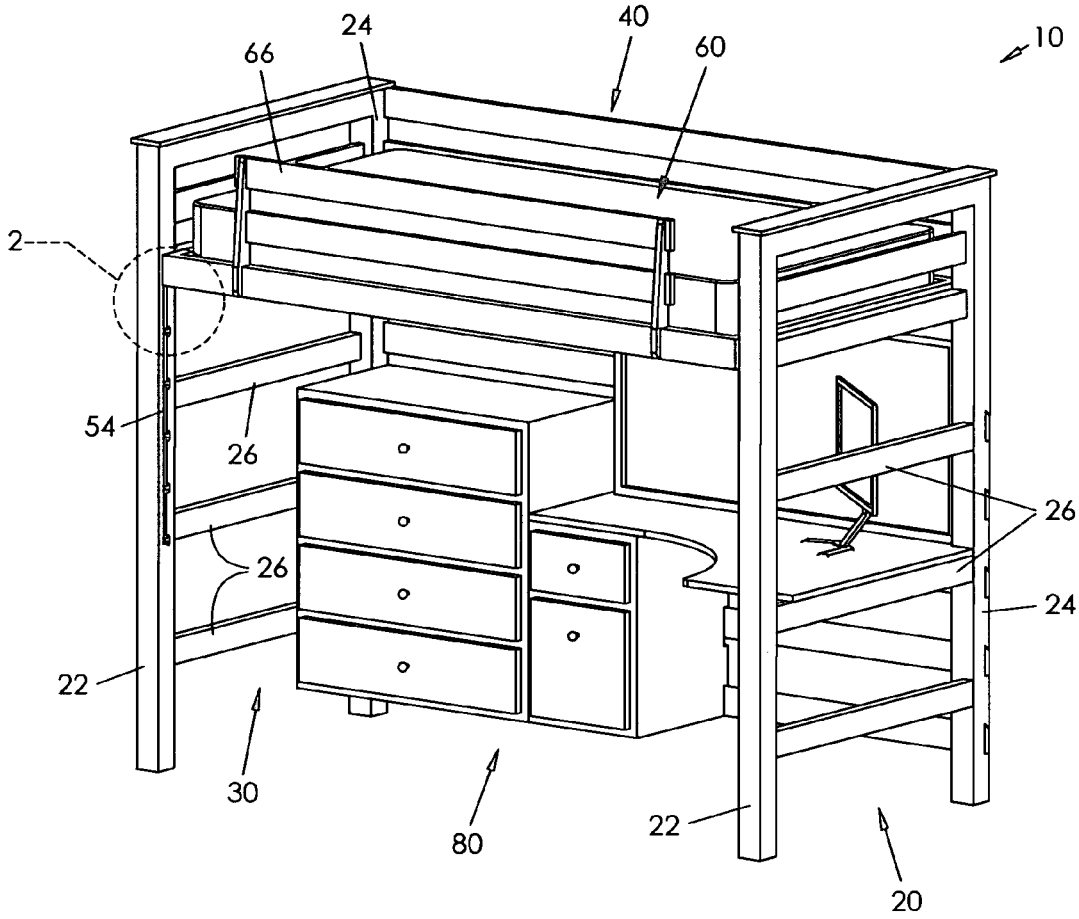
FIG. 1a
FIG. 1b
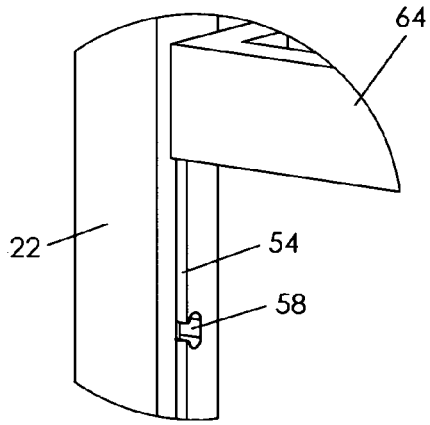

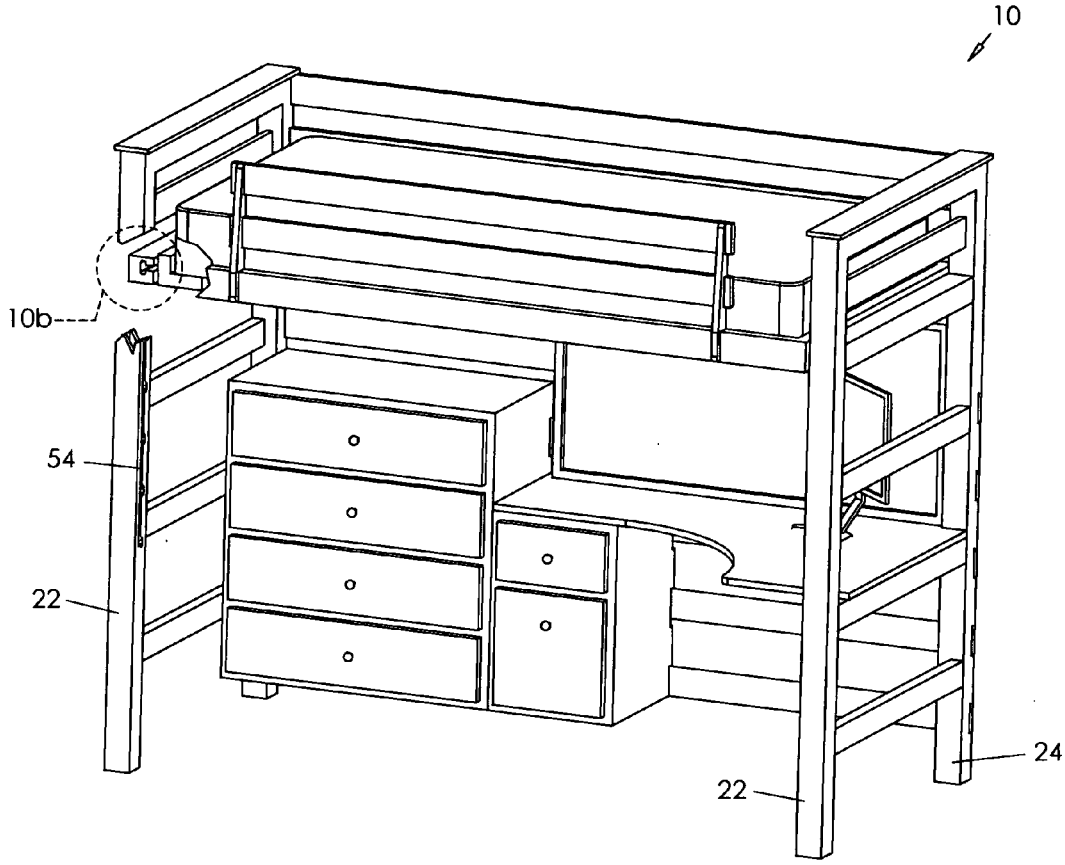
FIG. 10a
FIG. 10b
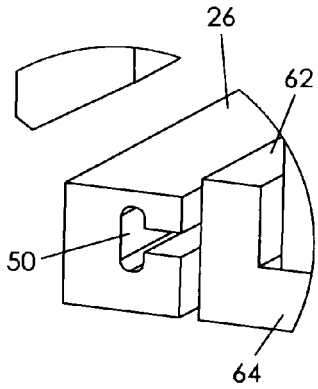

FOLD DOWN LOFT BED WITH MODULAR FURNITURE

CROSS REFERENCE TO RELATED APPLICATION

This non-provisional patent application claims the benefit of provisional application Ser. No. 61/085,104 filed on Jul. 31, 2008, titled Fold Down Loft Bed With Modular Furniture.

BACKGROUND OF THE INVENTION

This invention relates generally to furniture and, more particularly, to a fold down loft bed having modular furniture in some embodiments.

Loft beds are popular in that the bed is positioned at a heightened position that enables the space below it to be used for other purposes such as storage or to enable the use of other furniture. A loft bed may provide desirable options in that furniture such as a dresser or a desk may be positioned below a bed frame or even be attached thereto. However, like with a traditional bunk bed, it is difficult to change the sheets of an upper bunk without moving the entire bed frame away from the wall, by standing on a chair, or even climbing atop the bunk itself.

Various devices have been proposed in the art for making it easier to change the sheets of an upper bunk of a bunk bed. Other devices have been proposed for providing a bunk bed with furniture positioned beneath an upper bunk. Although assumably effective for their intended purposes, the existing devices do not provide a loft bed that may be lowered safely and securely and that provides multiple modular furniture options positioned below the upper bunk.

Therefore, it would be desirable to have a loft bed that safely folds down for easy access while changing its sheets. Further, it would be desirable to have a loft bed is easily moved and securely held into a folded configuration and that is easily urged back into a horizontal sleep configuration. In addition, it would be desirable to have a loft bed that is adaptable to multiple furniture configurations positioned relative to the bed framework beneath the bunk.

SUMMARY OF THE INVENTION

A fold down loft bed according to the present invention includes a framework including a head portion and a foot portion, each of the head and foot portions having front and back upstanding posts and a plurality of connector members extending between respective front and back upstanding posts. The framework includes a back portion interconnecting the head and foot portions, wherein the head and foot portions each includes a respective connector member having an interior surface defining a roller guide channel, each the roller guide channel extending substantially between respective front and back upstanding posts of the head and foot portions. Each front upstanding post includes an interior surface defining a pin guide channel extending vertically therealong between upper and lower guide channel ends. An upper bed frame includes opposed end rails with opposed side rails extending between respective ends of respective end rails.

A pair of rollers are attached to respective end rails of the upper bed frame and extending outwardly therefrom, the pair of rollers having a configuration complementary to a configuration of respective roller guide channels for receipt and relative movement therein. A pair of pins are attached to respective end rails of the upper bed frame and extending outwardly therefrom, the pair of pins having a configuration complementary to a configuration of respective pin guide channels for receipt and relative movement therein. The bed frame is movable between a sleep configuration when the rollers are positioned in respective roller guide channels adjacent respective back upstanding posts and respective pins are positioned in respective pin guide channels adjacent respective upper ends thereof and a folded configuration when the rollers are positioned in respective roller guide channels adjacent respective front upstanding posts and respective pins are positioned in respective pin guide channels adjacent respective lower ends thereof.

Therefore, a general object of this invention is to provide a foldable loft bed in which an upper bunk may be moved between a sleep configuration and selected foldout out configurations.

Another object of this invention is to provide a loft bed, as aforesaid, in which the upper bunk is laterally and vertically slidable in respective guide framework channels for movement between selectable configurations.

Still another object of this invention is to provide a loft bed, as aforesaid, having a recoil assembly for assisting and controlling bunk movement.

Yet another object of this invention is to provide a loft bed, as aforesaid, that may be configured into selected modular furniture configurations.

Other objects and advantages of the present invention will become apparent from the following description taken in connection with the accompanying drawings, wherein is set forth by way of illustration and example, embodiments of this invention.

BRIEF DESCRIPTION OF THE DRAWINGS

FIG. 1*a* is a perspective view of a loft bed according to a preferred embodiment of the present invention;

FIG. 1*b* is an isolated view on an enlarged scale taken from FIG. 1*a;*

FIG. 10*a* is a perspective view as in FIG. 1*a* with portion thereof fragmented for clarity;

FIG. 10*b* is an isolated view on an enlarged scale taken from FIG. 10*a;*

DESCRIPTION OF THE PREFERRED EMBODIMENT

Figure 2:
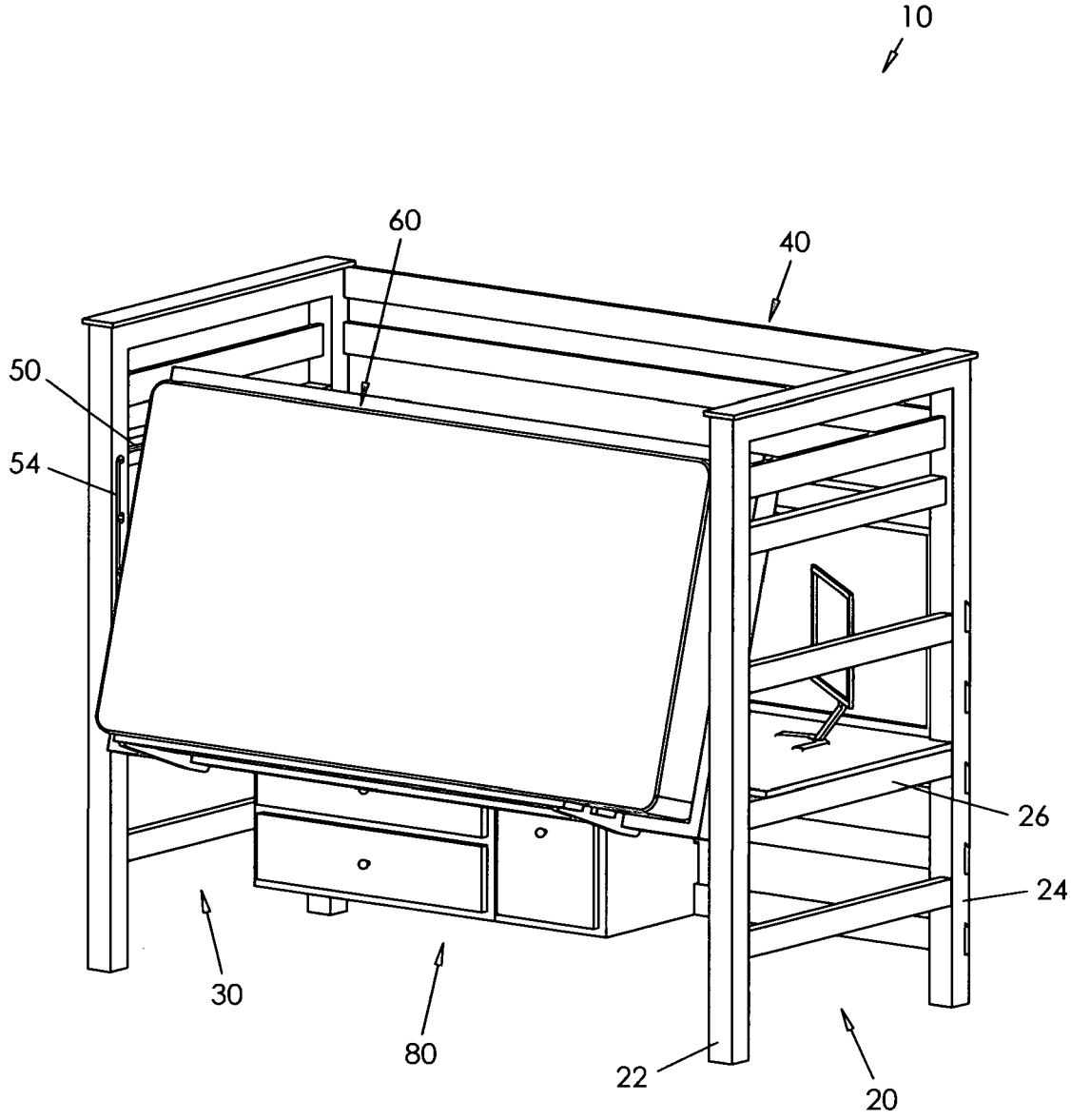
FIG. 2 is a perspective view of the loft bed as in FIG. 1*a* with the upper bunk in a folded out configuration.
Figure 3:
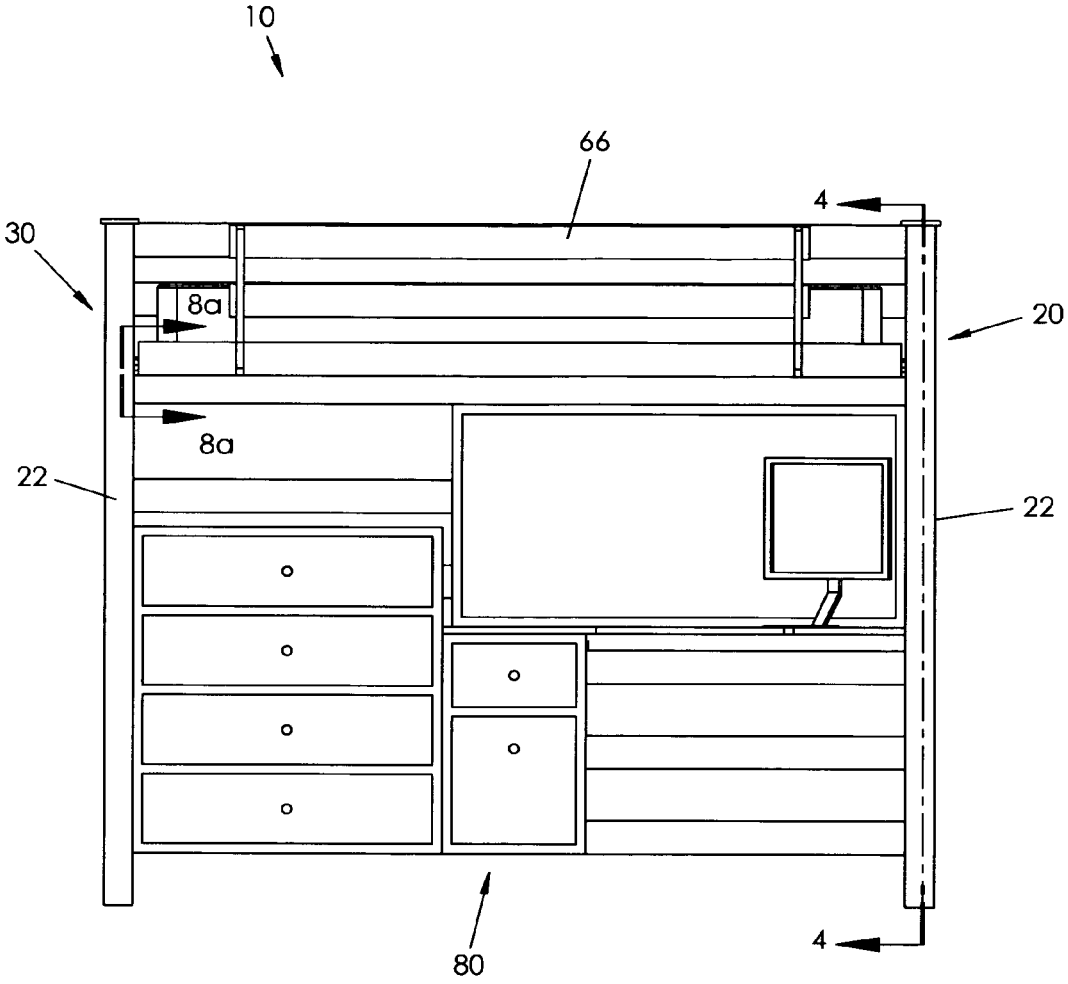
FIG. 3 is a front view of the loft bed as in FIG. 1*a;*

A folded loft bed according to a preferred embodiment of the present invention will now be described with reference to FIGS. 1 to 10*b* of the accompanying drawings. More particularly, the folded loft bed 10 includes a framework having a head portion 20 and a foot portion 30 (FIG. 1*a*), these portions being interconnected by a back portion 40. The head and foot portion each includes a front 22 and back 24 upstanding post and a plurality of connecting members extending between respective back and front posts. The connector members 26 provide strength and stability to the framework and also may be used as ladder rungs, as will become apparent later. Preferably, the upstanding posts 22, 24 are positioned vertically and the connector members 26 are positioned horizontally relative to the posts.

Figure 8A:
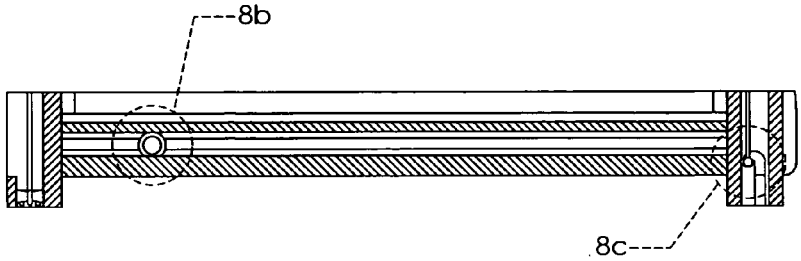
FIG. 8*a* is a sectional view taken along line 8*a*-8*a* of FIG. 3.
Figure 8B:
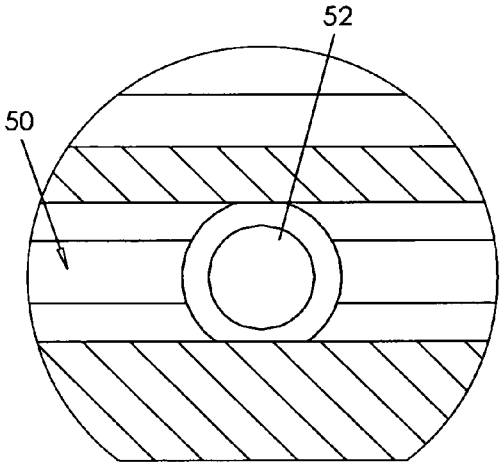
FIG. 8*b* is an isolated view on an enlarged scale taken from FIG. 8*a;*
Figure 8C:
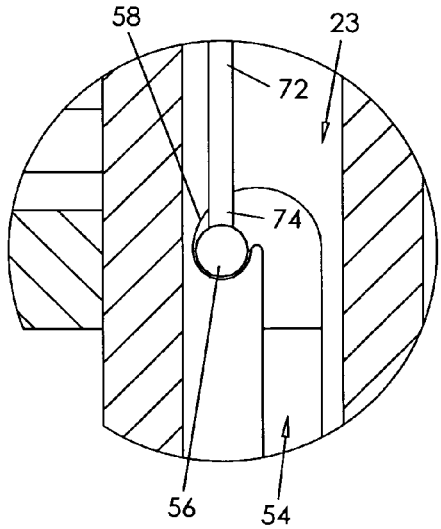
FIG. 8*c* is another isolated view on an enlarged scale taken from FIG. 8*a;*

Both the head portion 20 and the foot portion 30 include a special connector member 26 that includes an interior surface defining a roller guide channel 50 (FIGS. 8*b*, 10*b*). Each roller guide channel 50 extends substantially between respective front 22 and back 24 posts. Further, each front upstanding post 22 includes an interior surface defining a pin guide channel 54 extending therealong between upper and lower guide channel ends (FIGS. 1*a*, 1*b*). Each front upstanding post 22 further defines a plurality of spaced apart notches 58 in communication with respective pin guide channels 54, as will be further described below.

Figure 9A:
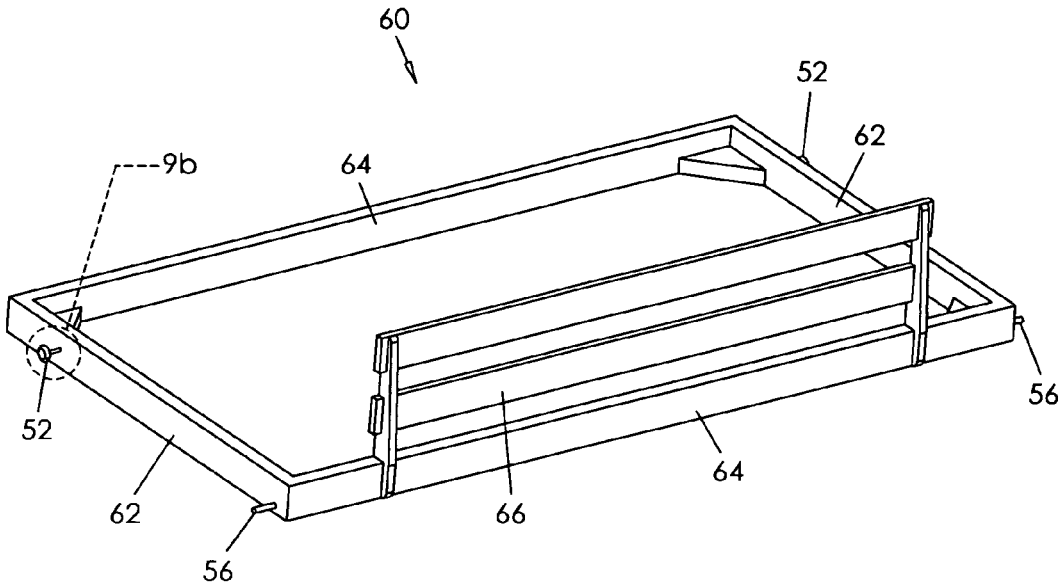
FIG. 9*a* is a perspective view of the upper bed frame as in FIG. 1*a* removed from the framework.
Figure 9B:
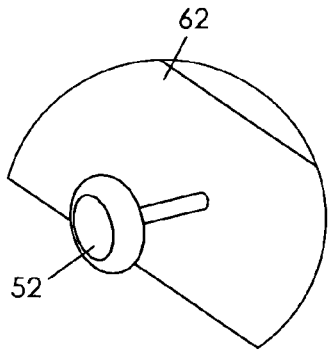
FIG. 9*b* is an isolated view on an enlarged scale taken from FIG. 9*a;*

The loft bed 10 further includes an upper bunk having an upper bed frame 60 having opposed end rails 62 and opposed side rails 64 extending between respective end rails 62 (FIGS. 1*a*, 9*a*). A roller 52 is attached to an outer surface of each end rail 62 and extends outwardly therefrom, each roller 52 being positioned generally adjacent the framework back portion 40 (FIG. 9*a*). Each roller 52 includes a configuration that is complementary to respective roller guide channels 50 such that it is received therein and movable therealong (FIG. 8*b*), as will be described in more detail below. A pin 56 is fixedly attached to the outer surface of each end rail 62 and extends outwardly therefrom (FIG. 9*a*). Each pin 56 is configured to be received in respective pin guide channels 54 for relative movement therein (FIG. 8*c*), as will be described in more detail below. The pins 56 may be selectively nested in the notches 58. A safety rail 66 is attached to a side rail 64 of the upper bed frame 60 opposite the back portion 40 of the framework (FIG. 1*a*).

The upper bed frame 60 is movable between a sleep configuration (also referred to as a use configuration) and multiple selected fold down configurations in that the rollers 52 and pins 56 are movable in the roller guide channels 50 and pin guide channels 54, respectively. More particularly, a user may urge the bed frame 60 in a forward direction from its normal "sleep" or "rest" configuration (FIG. 1). At first, the pins 56 are urged out of the first notch, the rollers 52 are urged forward along respective roller guide channels 50, and the pins 56 are urged downwardly along respective pin guide channels 54. Accordingly, the bed frame 60 may be folded out and down as shown in FIG. 2. The pins 56 may be secured in selected notches 58 such that the bed is stable in whatever folded configuration is desired.

Figure 4:
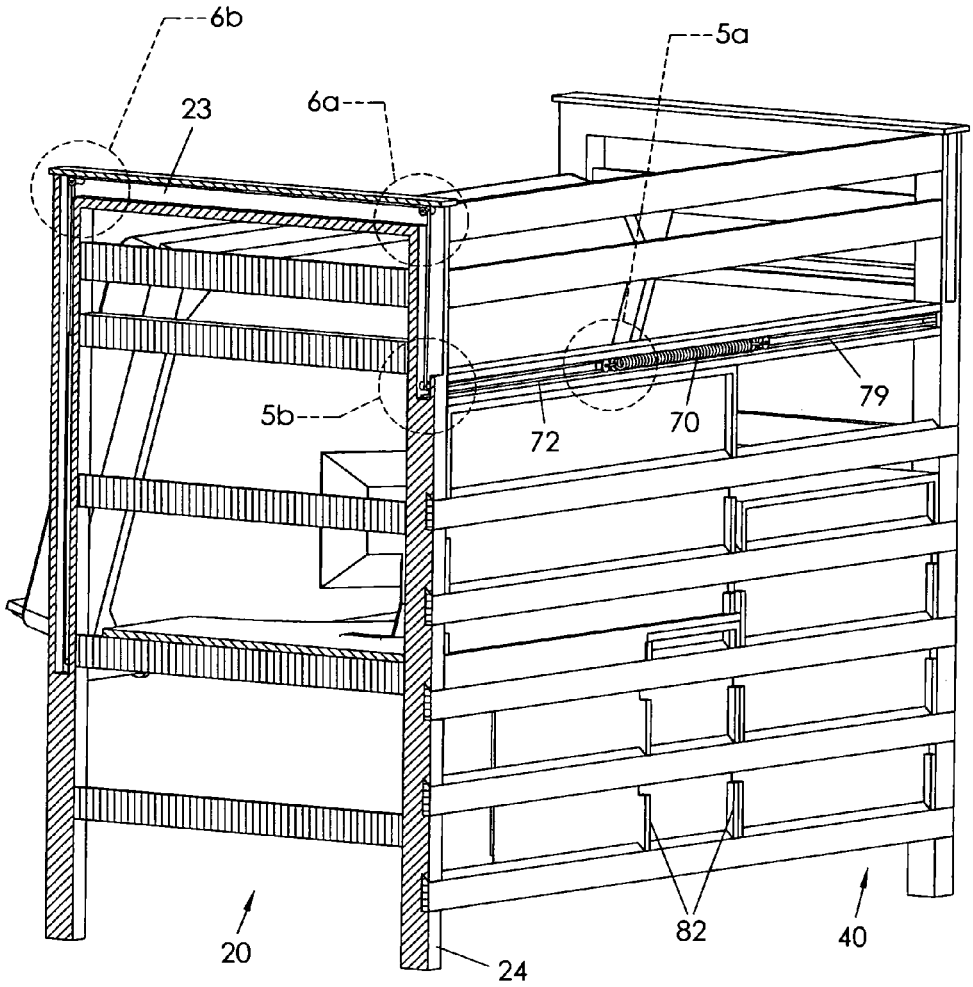
FIG. 4 is a sectional view taken along line 4-4 of FIG. 3.
Figure 5A:
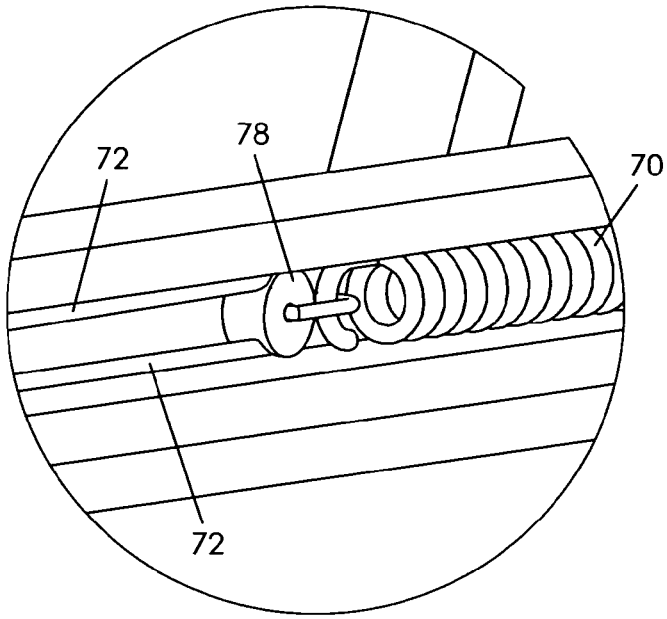
FIG. 5*a* is an isolated view on an enlarged scale taken from FIG. 4.
Figure 5B:
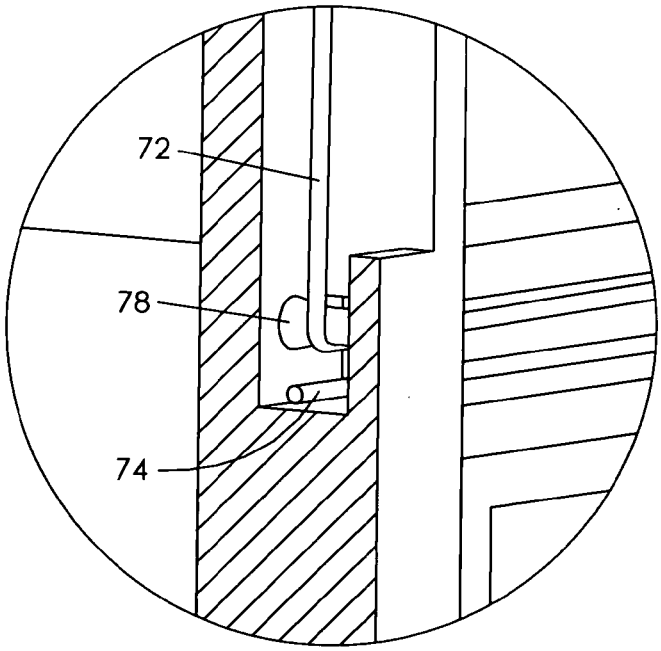
FIG. 5*b* is another isolated view on an enlarged scale taken from FIG. 4.
Figure 6A:
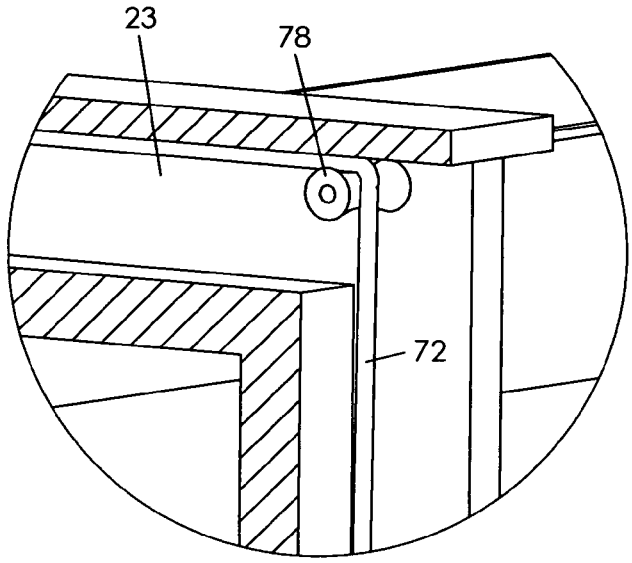
FIG. 6*a* is another isolated view on an enlarged scale taken from FIG. 4.
Figure 6B:
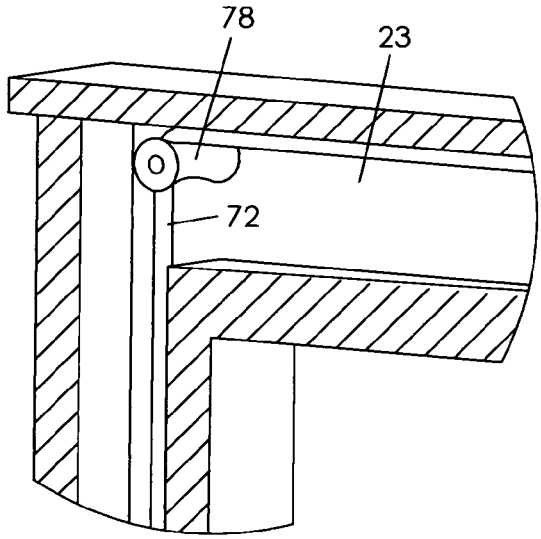
FIG. 6*b* is another isolated view on an enlarged scale taken from FIG. 4.

Each upstanding post 22, 24 defines a hollow interior space. The loft bed 10 includes a recoil assembly for assisting with movement of the upper bed frame 60 from an extended/folded out configuration back to a "sleep" configuration. More particularly, the recoil assembly includes a spring 70 attached the back portion 40 of the framework (FIG. 4). The recoil assembly includes a first cable 72 having a first end 74 coupled to one end of the spring 70 (FIG. 5*a*) and extending through the interior space of a respective upstanding post. The first cable 72 includes a second end 74 coupled to a respective pin 56 of the upper bed frame 60 (FIG. 5*b*). The spring 70 is movable between a recoiled configuration (also referred to as an "at rest" configuration) when the bed frame 60 is at a "sleep" configuration (FIG. 1*a*). The spring 70 is movable between a recoiled configuration (FIG. 1*a*). The spring 70 is at an extended or stretched configuration when the bed frame 60 is moved to a folded down configuration (FIG. 2). The spring 70 biases the bed frame 60 toward the sleep configuration. As shown in FIGS. 6*a* and 6*b*, guide members 78 are positioned within the hollow interiors of back portion connector members and upstanding posts to guide the first 72 and second 74 cables that extend between the spring 70 (FIG. 4) and the bed frame pins 56 (FIG. 5*b*).

Figure 7:
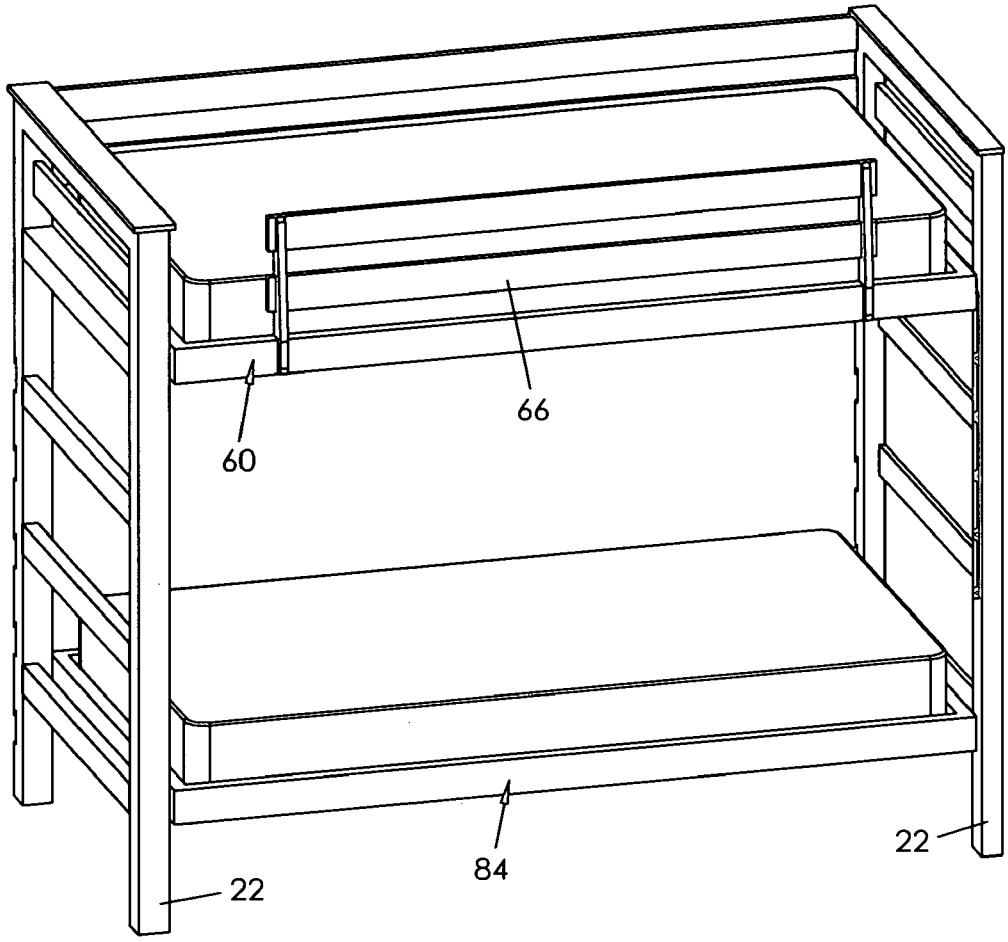
FIG. 7 is a perspective view of a loft bed having a lower bunk according to another embodiment of the present invention.

Further, the loft bed 10 includes one or more pieces of modular furniture 80 selectively coupled to the framework. Although not inclusive, the modular furniture may include one of the dresser, a desk, a countertop, or a bookshelf. Each piece of modular furniture includes one or more flanges 82 configured to rest upon respective connector members 26 of the back portion 40 of the framework (FIG. 4). The flanges may be attached using appropriate fasteners. The loft bed 10 may also include a lower bed frame 84 mounted to the head and foot portions of the framework (FIG. 7).

Figure 11:
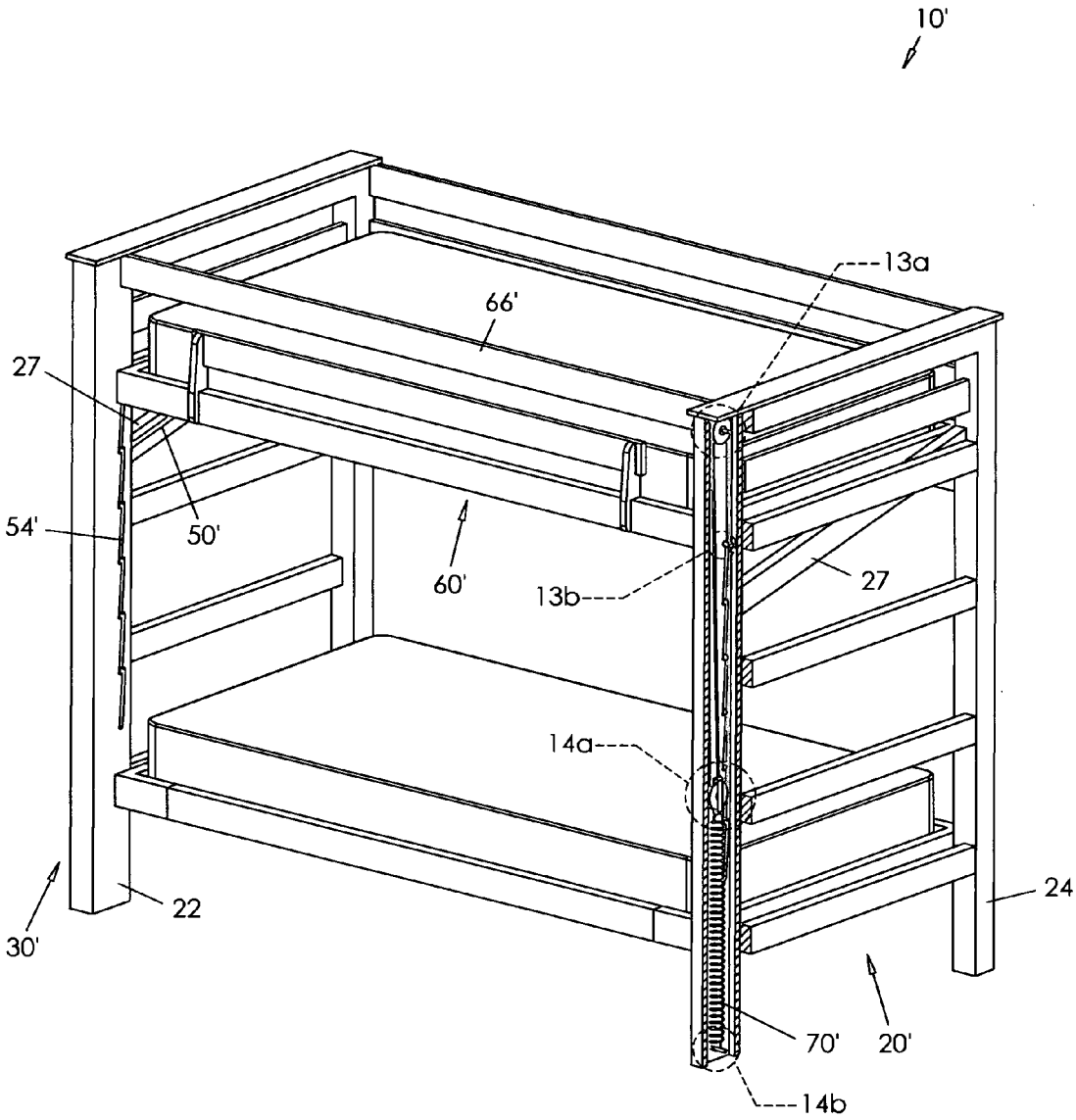
FIG. 11 is a perspective view of a loft bed according to another embodiment of the present invention with the upper bed frame in a sleep configuration.
Figure 12:
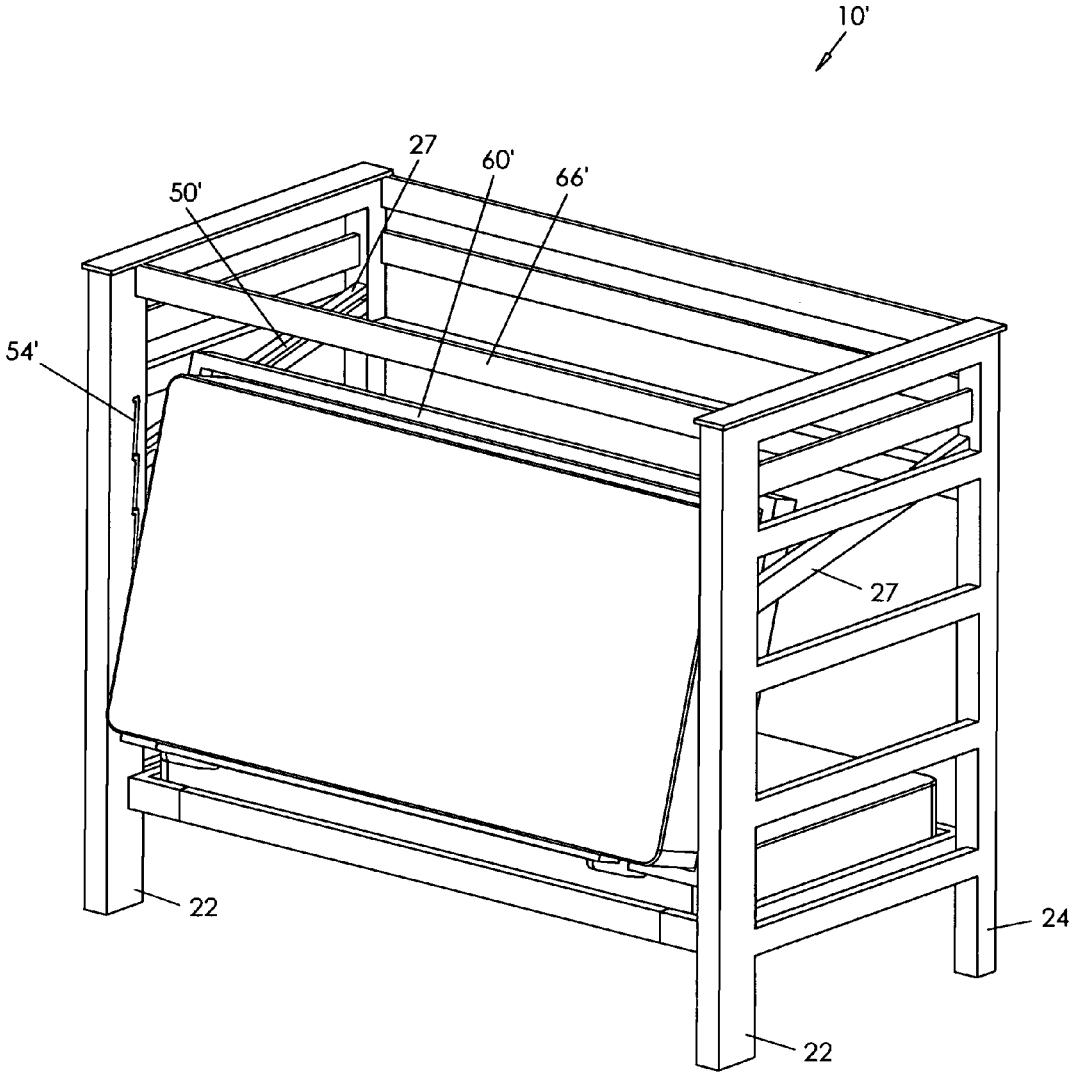
FIG. 12 is a perspective view of the loft bed as in FIG. 11 with the upper frame bed in a folded down configuration.

Another embodiment of the loft bed 10' is shown in FIGS. 11 to 14*b* and includes a construction substantially as disclosed previously except as specifically pointed out. Primed reference numerals will be used for the same or substantially similar constructive elements, new reference numerals being used for new or additional structures. The loft bed 10' according to this embodiment includes an auxiliary connector member 27 extending downwardly from a respective back post 24 to a respective front post 22 (FIGS. 11, 12). Each auxiliary connector member 27 is positioned near an upper end of the head 20' and foot 30' portions of the framework, respectively. An inner surface of each auxiliary connector member 27 defines a respective roller guide channel 50' for engagement with respective rollers, as described previously. In other words, the auxiliary connector members 27 are positioned so that the upper bed frame 60' may be moved downwardly more easily from a sleep configuration (FIG. 11) to a folded-out configuration (FIG. 12). Having the auxiliary connector member 27 reaching a lower configuration also assists persons having a shorter stature to reach the bed frame 60' at the folded-out configuration (FIG. 12). Inner surfaces of respective front posts 22 may define pin guide channels 54' having a modified configuration compared to the configuration previously described. It is understood that the auxiliary connector member 27 may simply be one of the aforementioned connector members 26 but situated in a downward configuration, as described. In addition, this embodiment may include an auxiliary safety rail 66' that extends between respective front posts 22' of the head 20' and foot 30' portions of the framework.

Figure 13A:
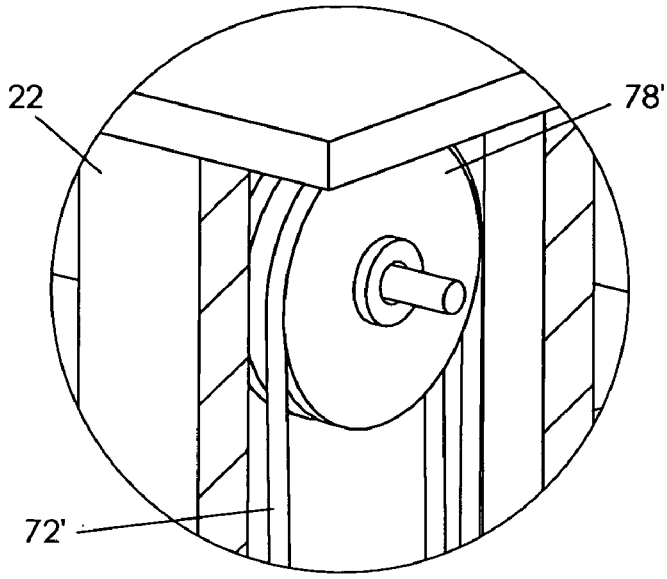
FIG. 13*a* is an isolated view on an enlarged scale take from FIG. 12.
Figure 13B:
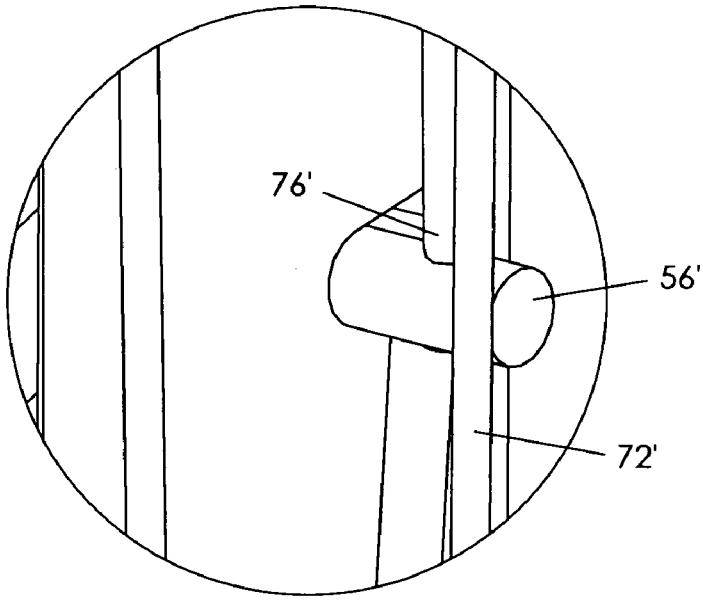
FIG. 13*b* is another isolated view on an enlarged scale take from FIG. 12.
Figure 14A:
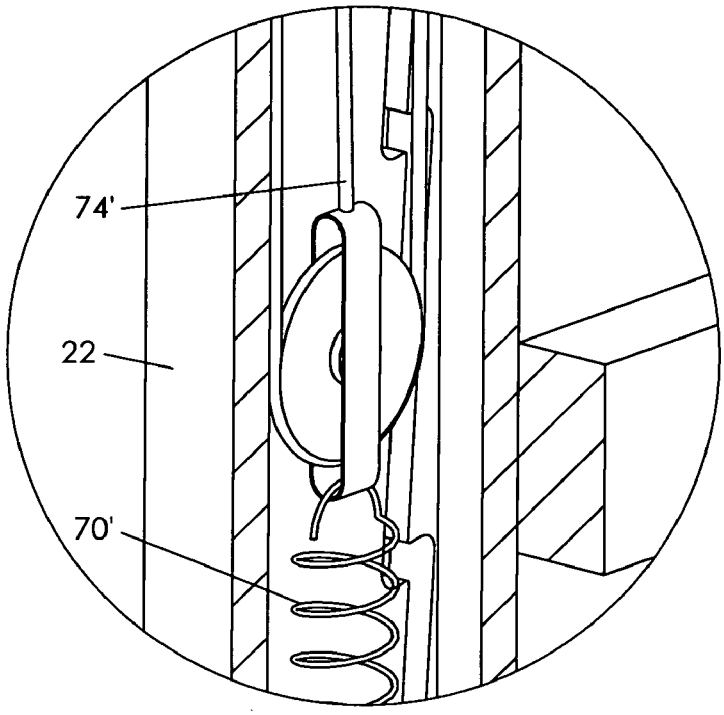
FIG. 14*a* is another isolated view on an enlarged scale take from FIG. 12.
Figure 14B:
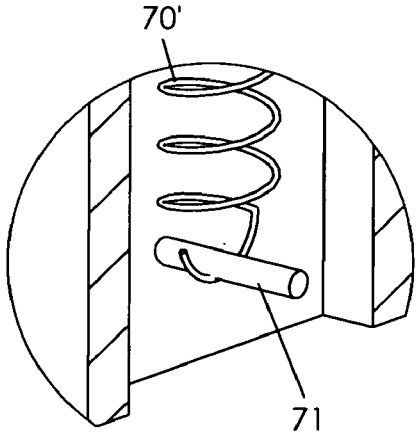
FIG. 14*b* is another isolated view on an enlarged scale take from FIG. 12.

Further, each front post 22 defines a hollow interior space. The recoil assembly is positioned substantially within one or both front posts 22. More particularly, the spring 70' is positioned in the interior space of the front post 22' and includes a first end attached to a securing pin 71 or to the bottom of the post itself (FIG. 14*b*), preferably adjacent to a lower end of the front post 22. The recoil assembly includes a first cable 72' having its first end 74' coupled to an upper end of the spring 70' (FIG. 14*a*) and extending through the interior space of the front post 22. As best shown in FIGS. 13*a* and 13*b*, the first cable 72' may extend about a pulley or other suitable guide member 78' situated near an upper end of the front post 22 and then attached at a second end 76' thereof to a respective bed frame pin 56'.

When the upper bed frame 60' is pulled forward and downward by a user (e.g. movement from a sleep configuration to a fold out configuration), the rollers 52' roll forward along the roller channels 50' in the downwardly situated auxiliary connector member 27. In addition, the guide pins 56' move along the pin guide channels 54'. The bed frame may be positioned at a selected position for a user to access the bed frame, such as to change the sheets. As described above, as the upper bed frame 60' is moved downwardly, the first cable 72' of the recoil assembly will urge the spring 70' to expand and thus bias the spring 70'. Consequently, the spring 70' will urge the bed frame to move back to the sleep configuration once released by a user to do so.

It is understood that while certain forms of this invention have been illustrated and described, it is not limited thereto except insofar as such limitations are included in the following claims and allowable functional equivalents thereof.

What is claimed is:

1. A fold down loft bed, comprising:

a framework including:

a head portion and a foot portion, each of said head and foot portions having front and back upstanding posts and a plurality of connector members extending between respective front and back upstanding posts;

a back portion interconnecting said head and foot portions;

wherein each of said head and foot portions includes a respective connector member having an interior surface defining a roller guide channel, each said roller guide channel extending substantially between respective front and back upstanding posts of said head and foot portions;

wherein each front upstanding post includes an interior surface defining a pin guide channel extending vertically therealong between upper and lower pin guide channel ends;

an upper bed frame having opposed end rails and opposed side rails extending between ends of respective end rails;

a roller attached to each end rail of said upper bed frame and extending outwardly therefrom, said rollers having a configuration complementary to a configuration of respective roller guide channels for receipt and relative movement therein;

a pin fixedly attached to each end rail of said upper bed frame in substantially horizontal alignment with said rollers and extending outwardly therefrom, said pins having a configuration complementary to a configuration of respective pin guide channels for receipt and relative movement therein;

wherein said upper bed frame is movable between a sleep configuration when said rollers are positioned in respective roller guide channels adjacent respective back upstanding posts and a folded configuration when said rollers are positioned in respective roller guide channels adjacent respective front upstanding posts.

2. The fold down loft bed as in claim 1, wherein:

said upstanding posts are generally vertical;

said connector members are positioned horizontally relative to respective upstanding posts; and said pins move downwardly in said respective pin guide channels between respective upper and lower ends as said rollers move in said respective roller guide channels from adjacent respective back upstanding posts toward respective front upstanding posts.

3. The fold down loft bed as in claim 1, wherein:

each end rail of said upper bed frame includes a back end adjacent said framework back portion and a front end displaced from said framework back portion;

each roller is positioned adjacent a respective back end of said each end rail; and each pin is positioned adjacent a respective front end of said each end rail.

4. The fold down loft bed as in claim 3, wherein a guard rail is attached to a respective side rail of said upper bed frame opposed said framework back portion.

5. The fold down loft bed as in claim 4, further comprising a recoil assembly mounted to said framework and operatively coupled to said bed frame.

6. The fold down loft bed as in claim 1, wherein each pin guide channel includes a plurality of spaced apart notches having configurations complementary to said pins such that said upper bed frame is selectively held at selected positions between said upper and lower pin guide channel ends.

7. The fold down loft bed as in claim 1, wherein each front upstanding post defines a generally hollow interior space, said fold down loft bed further comprising:

a recoil assembly including:

a spring attached to said framework;

a first cable having a first end coupled to a respective upstanding post and operatively coupled to one end of said spring and extending through said interior space of said respective upstanding post, said first cable having a second end coupled to a respective pin of said upper bed frame; and wherein said spring is movable between a recoiled configuration when said upper bed frame is at said sleep configuration and an extended configuration when said upper bed frame is at said folded configuration.

8. The fold down loft bed as in claim 7, wherein said spring is biased to return said upper bed frame to said sleep configuration.

9. The fold down loft bed as in claim 8, further comprising a second cable having a first end coupled to another respective upstanding post and operatively coupled to another end of said spring and extending through said interior space of another respective upstanding post, said second cable having a second end coupled to another respective pin of said upper bed frame.

10. The fold down loft bed as in claim 1 further comprising a lower bed frame mounted at opposed ends to said head and foot portions of said framework.

11. The fold down loft bed as in claim 7, further comprising a lower bed frame mounted at opposed ends to said head and foot portions of said framework.

12. The fold down loft bed as in claim 1, further comprising at least one furniture piece mounted to said framework beneath said upper bed frame, said at least one furniture piece having a flange configured to rest upon a connector member of said back portion of said framework.

13. The fold down loft bed as in claim 7, further comprising at least one furniture piece mounted to said framework beneath said upper bed frame, said at least one furniture piece having a flange configured to rest upon a connector member of said back portion of said framework.

14. The fold down loft bed as in claim 9, further comprising at least one furniture piece mounted to said framework beneath said upper bed frame, said at least one furniture piece having a flange configured to rest upon a connector member of said back portion of said framework.

15. The fold down loft bed as in claim 1, wherein:

said upstanding posts are generally vertical;

said respective connector members defining said roller guide channels extend downwardly between respective back upstanding posts and respective front upstanding posts; and said pins move downwardly in said respective pin guide channels between respective upper and lower ends as said rollers move in said respective roller guide channels from adjacent respective back upstanding posts toward respective front upstanding posts.

16. The fold down loft bed as in claim 3, further comprising an auxiliary guard rail extending between upper ends of respective front upstanding posts.

* * * * *